US006055730A

United States Patent [19]

Burke

[11] Patent Number: 6,055,730

[45] Date of Patent: May 2, 2000

[54] METHOD FOR ADJUSTING SCREW JACKS FOR SUPPORTING STRINGERS AND JOISTS IN CONSTRUCTION OF A BUILDING

[76] Inventor: John Michael Burke, 4321 Marion Ave., Cypress, Calif. 90630

[21] Appl. No.: 08/837,323

[22] Filed: Apr. 11, 1997

[51] Int. Cl.[7] ..... B23P 11/02

[52] U.S. Cl. ..... 29/897.3; 52/126.7; 52/127.7; 52/DIG. 1; 254/DIG. 2

[58] Field of Search ..... 29/897.3, 897.312; 173/29; 464/177; 52/111, 126.7, 127.7, DIG. 1, 125.1; 254/DIG. 2, 105

[56] References Cited

U.S. PATENT DOCUMENTS

| | | |
|---|---|---|
| 2,596,976 | 5/1952 | Barber . |
| 3,458,173 | 7/1969 | Kornovich et al. . |
| 3,490,547 | 1/1970 | Stewart . |
| 3,592,443 | 7/1971 | Budrow . |
| 3,764,110 | 10/1973 | Csapo et al. . |
| 3,810,603 | 5/1974 | Metz . |
| 3,863,896 | 2/1975 | Hope et al. . |
| 4,062,156 | 12/1977 | Roth . |
| 4,202,528 | 5/1980 | Foster . |
| 4,456,042 | 6/1984 | Clark et al. . |
| 4,555,880 | 12/1985 | Gzym et al. . |
| 4,749,169 | 6/1988 | Pickles . |
| 4,793,275 | 12/1988 | Usher . |
| 4,808,030 | 2/1989 | Takegawa . |
| 4,833,746 | 5/1989 | Yong . |
| 5,150,557 | 9/1992 | Gregory . |
| 5,306,031 | 4/1994 | Quinn et al. . |
| 5,496,014 | 3/1996 | Hsu . |

*Primary Examiner*—David P. Bryant
*Attorney, Agent, or Firm*—Hill & Simpson

[57] ABSTRACT

A tool and method provide a labor saving procedure for positioning the collars of screw jacks on base frames at desired heights at construction heights. A conventional electric motor driven drill is coupled to the screw jack pipe by the tool to rotate the pipes for positioning the collar at desired levels on the pipe.

3 Claims, 2 Drawing Sheets

FIG. 2
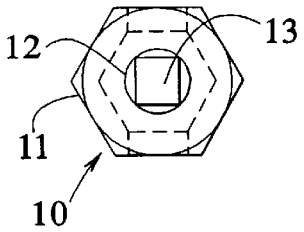
FIG. 4
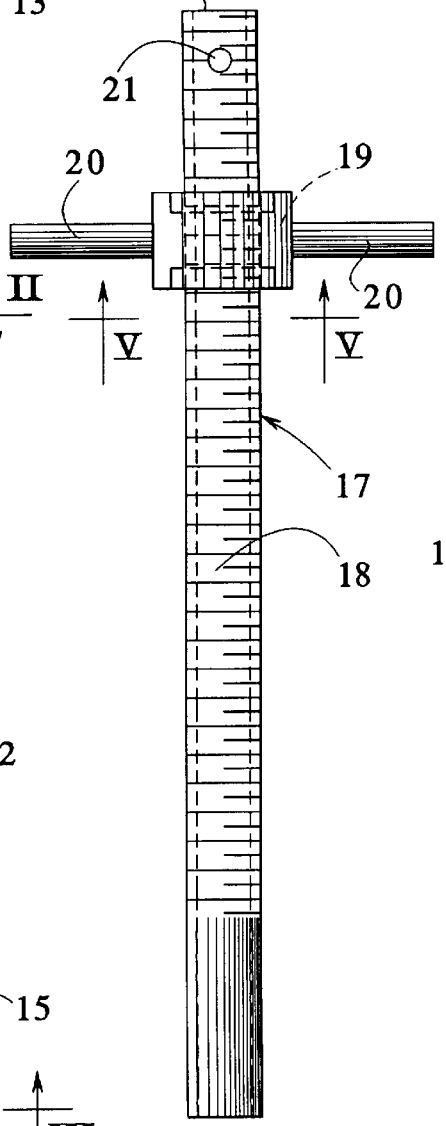
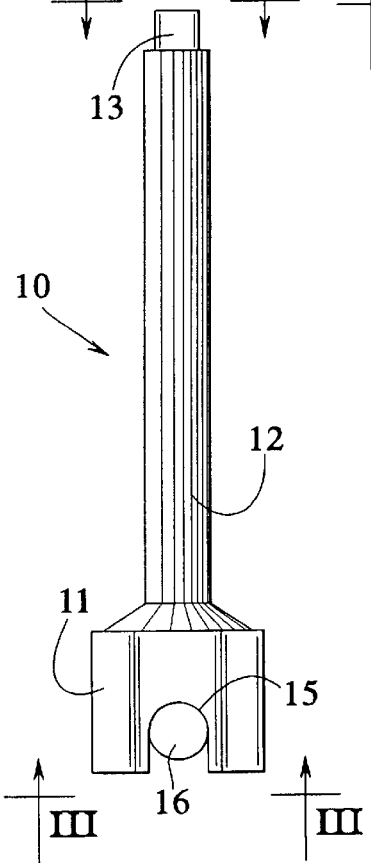
FIG. 1
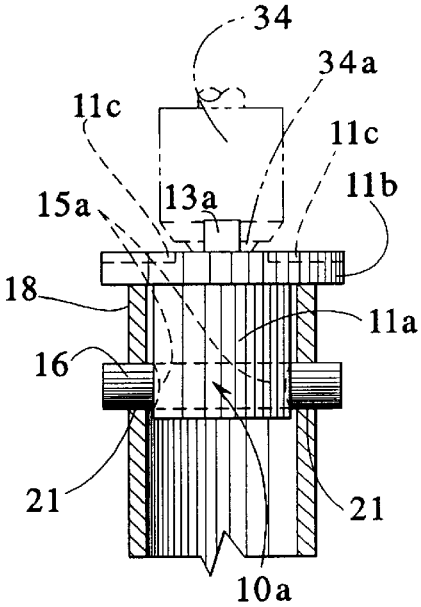
FIG. 10
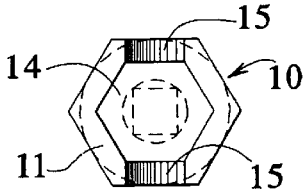
FIG. 3
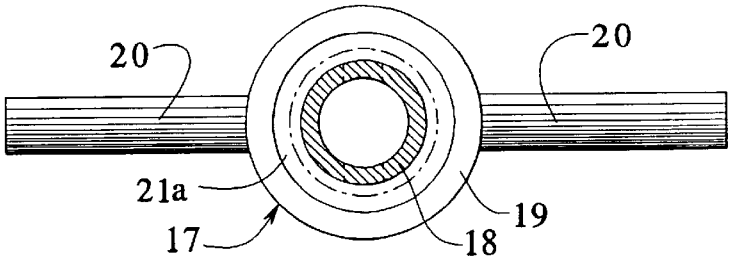
FIG. 5

METHOD FOR ADJUSTING SCREW JACKS FOR SUPPORTING STRINGERS AND JOISTS IN CONSTRUCTION OF A BUILDING

BACKGROUND OF THE INVENTION

This invention relates to the art of building constructions using screw jacks to support stringers and joists for decks onto which are poured concrete to form slabs providing supporting floors and roofs of buildings and to tools for such jacks.

SUMMARY OF THE INVENTION

Heretofore such screw jacks had externally threaded pipes or tubes threaded through surrounding collars which had laterally extending handles that were grasped by the construction crews and hand rotated around the pipe or tube to position the collars at a desired level along the length of the screw pipe. The screw jacks were then mounted in base frames by inserting the pipe in the open end of a base frame pipe or tube with the collar bottomed against the open end of this base frame pipe. The portion of the screw pipe projecting beyond the frame pipe then determined the effective height of the base frame. A cover plate or a base plate was then placed over the exposed end of the screw tube to receive an aluminum joist. Literally, many hundreds of these base frames and screw jacks were required in a construction site to support successive concrete slabs in multi-vertically spaced concrete slabs of multi-storied constructions.

The hand rotated collars of the screw jacks demanded hard time consuming labor.

It would be an improvement in this art to eliminate the heretofore required time and labor for rotating the collars to their required levels on the screw pipes of the screw jacks.

According to this invention the externally threaded pipe or tube of the screw jack is rotated within the stationary held collar by coupling it to a motor driven tool grasping the pipe.

A preferred form of this tool has a leading end slidably inserted in the end of the externally threaded screw pipe to engage a cross pin in the pipe and the trailing end of the tool is coupled to the conventional chuck of an electric motor driven drill and to use available structure on shipping crates for screw jacks to hold the collars of the jacks to receive the electric motor driven tool of this invention.

The sheets of drawings submitted with this application illustrate a preferred embodiment of the invention but it is to be understood that other embodiments are included within the scope of this invention.

BRIEF DESCRIPTION OF THE DRAWINGS

FIG. 1 is a longitudinal elevational view of the tool of this invention.

FIG. 2 is an end elevational view of the top end of the tool of FIG. 1 taken along the line II—II of FIG. 1;

FIG. 3 is a bottom elevational view of the tool of FIG. 1 taken along the line III—III of FIG. 1;

FIG. 4 is a reduced size longitudinal elevational view of a screw jack of the type used in conventional base frames for supporting and mounting joist and stringers for concrete slab constructions;

FIG. 5 is a transverse cross sectional view taken along the line V—V of FIG. 4;

FIG. 10 is a longitudinal elevational view of a modified form of the tool of this invention.

DESCRIPTION OF THE PREFERRED EMBODIMENT

Figure 6:
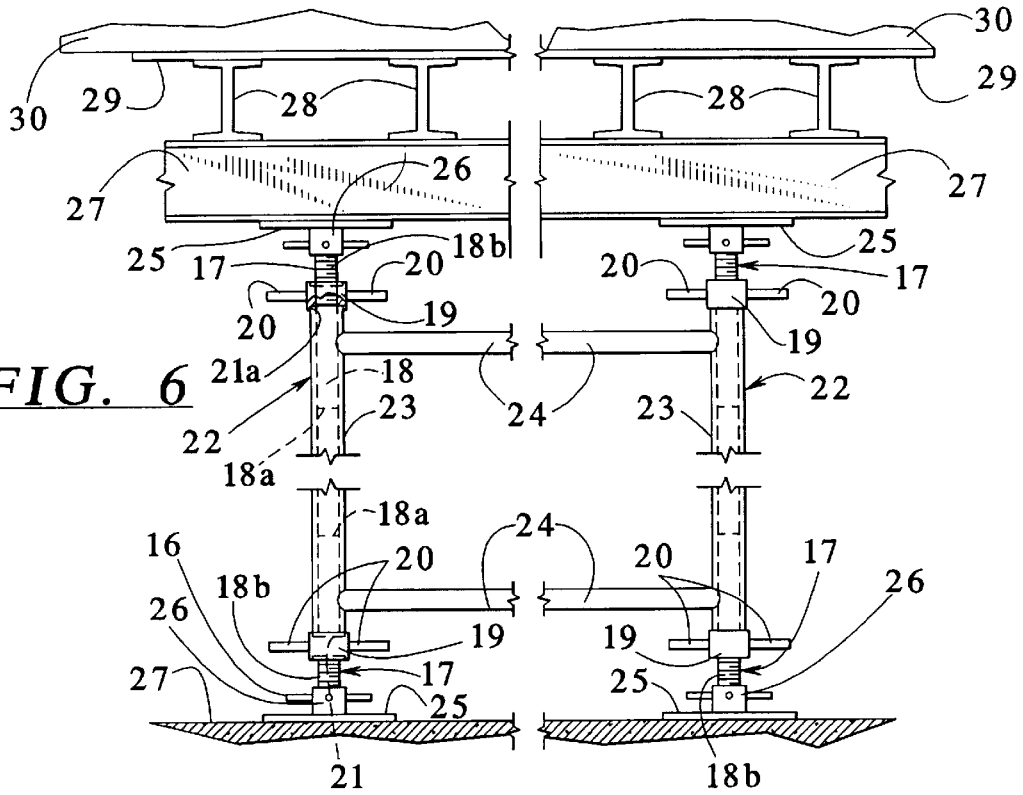
FIG. 6 is a broken longitudinal elevational view of a base frame equipped with screw jacks that have been positioned to project from the tops and bottoms of the frame to carry top and bottom base plates supporting a stringer and aluminum joists for the plywood deck of a concrete slab with a portion or collar broken away to illustrate the mounting of a screw jack collar on the end of a base frame pipe.
Figure 9:
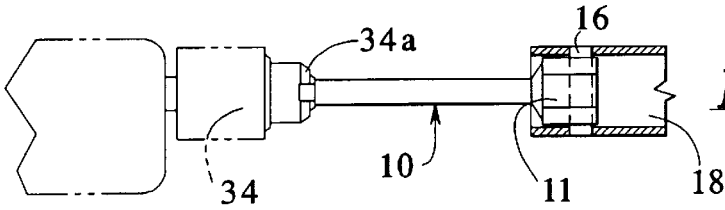
FIG. 9 is a broken fragmentary cross sectional view of the end of a screw pipe of a screw jack showing the manner in which the electric motor driven drill chuck is coupled to the pipe through the tool of this invention while slidable within the end of the screw pipe.
Figure 8:
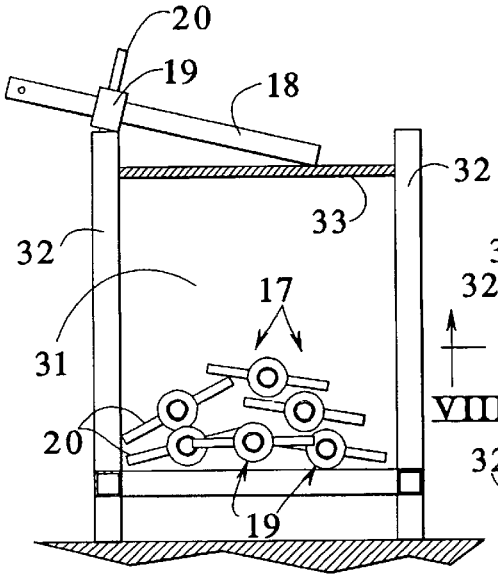
FIG. 8 is a cross sectional view along the line VIII—VIII of FIG. 7.

As illustrated in FIGS. 1–3 the tool 10 of this invention has a hexagonal leading end head 11 from which projects an elongated reduced diameter stem 12, the upper end 13 of which has four flat sides adapted to be inserted in a conventional chuck of an electric motor drill to be grasped by the drill for rotating the tool. The head 11 may be from 4 to 6 inches long for a good sliding fit within the screw jack pipe to prevent tilting of the tool and the stem 12 may be quite short to provide the upper end 13.

The leading head end 11 of the tool is hollow as illustrated at 14 with an open bottom having diametrically opposite recesses 15, 15 which are adapted to receive a cross pin 16 to be mounted in the screw jack.

As shown in FIG. 4, a conventional screw jack 17 illustrated in much reduced size has an externally threaded screw pipe 18 surrounded by and threaded through a collar 19 with laterally extending handles 20. The end portion or both lead portions of the screw pipe 18 has diametrically opposed holes 21 near its upper end or both leads 22 to receive the cross pin 16 therethrough and receive the recesses 15 of the tool head 11 for coupling the screw pipe 18 to the tool 10.

As shown in FIG. 5 an end face of the collar has an annular recess 21*a* around the screw pipe 18.

As shown in FIG. 6 a base frame 22 for top and bottom screw jacks 17 is composed of a pair of laterally spaced upright pipes 23 connected by cross braces 24. The top and bottom ends of these pipes 23 are seated in the annular recesses 21*a* of the screw jack collars. The leading ends of the screw pipes 18 project in sliding relation with the base frame pipes 23 for depths sufficient to support the screw pipes in upright position so that the base frame 22 provides the desired height support.

As also shown in FIG. 6 end plates 25 have collars 26 receiving the ends of the screw pipes 18 which are connected to the plates by the same type of pin 16 which coupled the tool 10 to the screw jack.

As further illustrated in FIG. 6 the bottom end plates 25 rest on a previously laid concrete slab 27 while the top end plates 25 receive an aluminum stringer 27 to support it at a desired height for a concrete slab to be laid above the floor base. As diagrammatically illustrated, the aluminum stringer 27 in turn receives cross joists 28 on which is laid a plywood deck 29 for the next concrete slab 30. These stringers and joists and the plywood deck are removed after the slab 30 has been set and the base frame 22, the stringers 27 and the joists 28 are raised to the next level.

It will be understood that the base frames 22 are held in desired spaced relationship along the entire widths and lengths of the construction site being formed. These base frames can be held in their upright positions by connecting braces (not shown).

Figure 7:
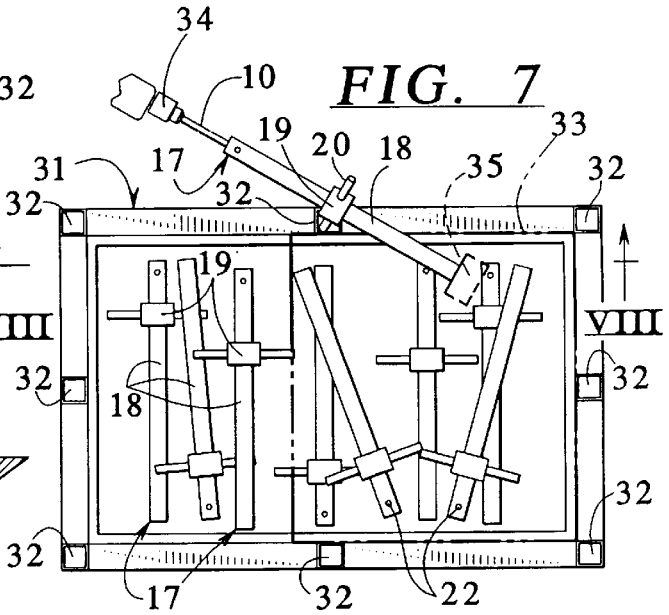
FIG. 7 is a top plan view of a conventional shipping crate for screw jacks and illustrating the manner in which the crate is used to mount a screw jack collar and screw pipe for rotating the pipe within the collar by a conventional motor driven source coupled to the pipe through the tool of this invention.

As shown in FIG. 7 a conventional screw jack shipping crate 31 can be used to mount the therein stored screw pipes 18 and their collars 19. These crates are received at the construction sites filled with the screw jacks having the collars 19 on the screw pipes at levels after being released from other jobs. The crates have hollow metal corner uprights 32 adapted to receive a handle 20 of the collar 19 to hold the screw pipe 18 horizontally at the top of the crate and at a convenient work level to be engaged by the tool 10. If desired a cover 33 on the crate can provide a platform on which the screw pipe can be supported as it projects from the collar 19 as it is rotated by the tool 10 under the power of an electric motor driven drill 34 coupled to the tool by its conventional chuck 34*a*. As the tool 10 drives the screw rod 18 through the collar it can be driven a desired measured distance or against a stop 35 on the cover 33 thereby determining the exposed length of the screw pipe 18 for controlling the effective height of the base frame 22. The electric motor driven drill 34 spins the screw pipe forwardly or rearwardly through the collar to the desired exposed length 18*a* while leaving a sufficient length 18*b* within the pipe 23 of the base frame so that the screw jack can not be tilted.

FIG. 10 shows a modified tool 10*a* of this invention wherein the tool head 11*a* is cylindrical along its complete length to the drill chuck 34*a* receiving the flat sided upper end 13*a* which only needs to be long enough to be gripped by the drill chuck. Instead of the recesses 15 to receive the cross pin 16, the head 11*a* has closed circumference cross holes 15*a* to receive the cross pin. A rim 11*b* on the head 11*a* can be bottomed on the end of the screw jack pipe 18 to align the holes 15*a* with the pipe holes 21 and a mark or notch 11*c* on this rim 11*b* can be used to register the pipe and head holes.

From the above description it should be understood that this invention provides an effective labor saving simple procedure for setting up base frames at construction sites utilizing conventional frames and screw jacks and even using packing crates from which screw jack parts are mounted.

Although the present invention has been described with reference to a specific embodiment, those skilled in the art will recognize that changes may be made thereto without departing from the scope and spirit of the invention as set forth in the appended claims.

I claim as my invention:

1. A method of adjusting the effective heights of construction base frames of the type having upright hollow pipes with screw jacks having externally threaded pipes in the ends thereof and collars with projection handles being threaded on the threaded pipes bottomed on the upright pipes, said screw jacks being shipped in crates having upright hollow frame members and a stop at a space from one of the hollow frame member, said method comprising providing a tool having a first end and a second end, coupling the first end to an end of a threaded pipe and coupling the second end to an electric motor, inserting the handle in one of the hollow frame members to hold the handle to prevent rotation of the collar, spinning the threaded pipe in the held collar to project the threaded pipes a selected height from the hollow pipe of the base frame by energizing the electric motor and by using the stop to limit the amount of spinning of the pipe.

2. A method according to claim 1, wherein the first end of the tool has means for receiving a pin, the end of the threaded pipe is a hollow member, and said step of coupling the first end includes mounting a cross pin in the end of the pipe, and inserting the first end of the tool into the hollow end of the pipe to engage the cross pin with the means for receiving.

3. A method according to claim 1, wherein the end of the threaded pipe is a hollow member having a cross bore, and said step of coupling includes inserting the first end into the hollow member, aligning the cross bore of the hollow member with a cross bore of the first end and inserting a pin into the aligned bores.

* * * * *